US006952538B2

(12) United States Patent
Hashiguchi et al.

(10) Patent No.: US 6,952,538 B2
(45) Date of Patent: Oct. 4, 2005

(54) IMAGE FORMING APPARATUS WITH HEATER HAVING BIAS APPLYING PORTION SETTING BIAS BASED ON SHEET WIDTH

(75) Inventors: Shinji Hashiguchi, Shizuoka (JP); Satoru Izawa, Shizuoka (JP); Hiroshi Kataoka, Shizuoka (JP); Koji Nihonyanagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/638,420

(22) Filed: Aug. 12, 2003

(65) Prior Publication Data

US 2004/0037579 A1 Feb. 26, 2004

(30) Foreign Application Priority Data

Aug. 23, 2002 (JP) ..... 2002-243598

(51) Int. Cl.[7] ..... G03G 15/20

(52) U.S. Cl. ..... 399/45; 399/67; 399/68; 399/322; 399/328

(58) Field of Search ..... 399/45, 67, 68, 399/320, 322, 324, 328, 329; 219/216

(56) References Cited

U.S. PATENT DOCUMENTS

| | | | | |
|---|---|---|---|---|
| 5,148,226 A | | 9/1992 | Setoriyama et al. | |
| 5,149,941 A | | 9/1992 | Hirabayashi et al. | 219/216 |
| 5,177,549 A | * | 1/1993 | Ohtsuka et al. | 399/320 |
| 5,210,579 A | | 5/1993 | Setoriyama et al. | |
| 5,525,775 A | | 6/1996 | Setoriyama et al. | 219/216 |
| 5,722,026 A | | 2/1998 | Goto et al. | 399/333 |
| 5,904,871 A | | 5/1999 | Sakai et al. | 219/216 |
| 5,920,757 A | | 7/1999 | Izawa et al. | 399/329 |
| 6,298,213 B1 | | 10/2001 | Miyamoto et al. | 399/320 |
| 6,438,348 B2 | | 8/2002 | Kobaru et al. | 399/333 |
| 6,519,426 B2 | | 2/2003 | Goto et al. | 399/69 |
| 6,804,478 B2 | * | 10/2004 | Martin et al. | 399/45 |
| 2002/0118977 A1 | | 8/2002 | Hasegawa et al. | 399/69 |
| 2002/0168202 A1 | | 11/2002 | Izawa et al. | 399/329 |
| 2003/0029853 A1 | | 2/2003 | Izawa et al. | 219/216 |
| 2003/0035667 A1 | | 2/2003 | Izawa et al. | 399/333 |
| 2003/0038125 A1 | | 2/2003 | Kataoka et al. | 219/216 |

FOREIGN PATENT DOCUMENTS

| | | |
|---|---|---|
| JP | 63-313182 | 12/1988 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |

* cited by examiner

*Primary Examiner*—William J. Royer
(74) *Attorney, Agent, or Firm*—Fitzpatrick, Cella, Harper & Scinto

(57) ABSTRACT

An image forming apparatus is provided with an image heating apparatus for holding and conveying a recording material bearing an image in a nip between a heating member and a pressurizing member to heat the image on the recording material. The image forming apparatus has a bias applying portion for applying a bias to at least one of the heating member and the pressurizing member and a bias setting portion for setting an amount of the applied bias. In the case that a recording material(s) having a first width is fed and thereafter a recording material is to be fed, the bias setting portion sets the amount of the applied bias based on the number of the recording material(s) having the first width that have been fed and the time from the feeding of the recording material(s) having the first width to the feeding of the recording material having the second width.

15 Claims, 5 Drawing Sheets

IMAGE FORMING APPARATUS WITH HEATER HAVING BIAS APPLYING PORTION SETTING BIAS BASED ON SHEET WIDTH

BACKGROUND OF THE INVENTION

1. Field of the Invention

The present invention relates to an image forming apparatus having an image heating apparatus that is adapted to hold and convey a recording material that bears an image in a nip between a heating member and a pressurizing member, to at least one of which a bias is applied, so as to heat the image on the recording material.

2. Related Background Art

Conventionally, a heat fixing apparatus using a heating roller scheme and a heat fixing apparatus using a film heating scheme or the like have been adopted as heat fixing means serving as an image heating apparatus to be equipped in an image forming apparatus such as a copying machine, a printer, a facsimile machine or the like that uses, for example, an electrophotography process. The heat fixing apparatus using the heating roller scheme is of a contact heating type that has a good heat efficiency and a high degree of safety, while the heat fixing apparatus using the film heating scheme has a quick-start ability (or an on-demand ability) and it is an energy-saving apparatus that is not supplied with electric power during a stand-by state so that power consumption would be reduced as little as possible.

The heat fixing apparatus using the heating roller scheme has a rotating fixing roller serving as a heating member that is heated by a built-in heat source such as a halogen heater and controlled to a predetermined temperature and a rotating pressure roller serving as a pressurizing member that is in pressure contact with the fixing roller at a predetermined pressure, and a recording material is introduced into a pressure contact nip portion (or a fixing nip portion) between those rollers so as to be held and conveyed therein, so that an unfixed image is heated to be fixed on the surface of the recording material.

The heat fixing apparatus using the film heating scheme is disclosed in prior art documents such as Japanese Patent Application Laid-Open No. 63-313182 and Japanese Patent Application Laid-Open No. 1-263679. The heat fixing apparatus using the film heating scheme causes a heat resisting film to run as a moving member under the state in which it is closely pressed to a heating member by a pressurizing member and introduces a recording material between the heat resisting film and the pressurizing member in a fixing nip portion formed by the heating member and the pressuring member with the heat resisting film between to bring the recording material into close contact with the heat resisting film so as to cause the recording material to pass through the fixing nip portion together with the heat resisting film. Thus, heat of the heating member is imparted to the recording material via the heat resisting film, so that an unfixed image is heated to be fixed on the surface of the recording material.

FIG. 7 shows the outline of an example of the heat fixing apparatus using the film heating scheme. In FIG. 7, reference numeral 27 designates a fixing unit serving as a heating member and reference numeral 18 designates an elastic pressure roller serving as a pressurizing member. These members 27 and 18 are in pressure contact with each other to form a fixing nip portion N.

The fixing unit 27 serving as the heating member is composed of a stay holder 17, a heating member 15 such as a ceramic heater securely held on the bottom surface of the stay holder 17 and a cylindrical fixing film 14 functioning as an elastic moving member loosely fitted on the stay holder 17. The fixing film 14 includes, in the following order from the outer surface, an insulative releasing layer, an electrically conductive layer and a substrate layer.

The elastic pressure roller 18 serving as the pressurizing member includes a metal core 29, an elastic layer 30 and a surficial insulative releasing layer 31.

The heating member 15 in the fixing unit 27 and the elastic pressure roller 18 serving as the pressurizing member that are mentioned above are opposed to each other, so that the fixing film 14 is held in a pressure contact and the fixing nip portion N is formed.

The elastic pressure roller 18 is driven to rotate counterclockwise. The fixing film 14 follows the rotation of the elastic pressure roller 18, and the fixing film 14 is brought into a clockwise rotating state as shown by an arrow while its inner surface is in close contact with the heating member 15 and sliding thereon in the fixing nip portion N.

A recording material P on which an unfixed toner image T is formed and born is introduced into the fixing nip portion N between the fixing film 14 and the elastic pressure roller 18 so as to be held and conveyed. In this holding and conveying process, the unfixed toner image T on the recording material P is heated in the fixing nip portion N by the heating member 15 via the fixing film 14 so as to be fixed with a pressurizing force of the fixing nip portion N applied thereto.

Both the heating roller scheme and the film heating scheme suffer from the following problems with respect to image quality that arise in the fixing process.

(1) Just before the introducing portion of the fixing nip portion N, a part of the unfixed toner image T on the recording material P is blown away in the downstream side of the recording material conveying direction. (This phenomenon will be referred to as "backward toner flying" hereinafter.)

(2) A part of the unfixed toner image T on the recording material P is not fixed but adhering to the fixing film 14 or the fixing roller, so that when the portion of the fixing film 14 or the fixing roller at which the toner is adhering is subsequently in contact with the recording material P, the toner on the fixing film 14 or the fixing roller is transferred to the recording material P to cause an image error. (This phenomenon will be referred to as "offset" hereinafter.)

In order to suppress these phenomena, methods for enhancing electrostatic adhering force of the toner to the recording material P have been conventionally developed.

Referring, for example, to the above-described heat fixing apparatus using the film heating scheme shown in FIG. 7, there has been adopted a method in which a predetermined amount of fixing bias having the same polarity as the unfixed toner image T (in this example the charge polarity of the unfixed toner image T is minus) is applied to the electrically conductive layer of the fixing film 14 (which includes an insulative releasing layer, an electrically conductive layer and a substrate layer in the mentioned order from the outer surface) by a fixing bias applying power source E via an electrically conductive brush 51 to press down the unfixed toner image T on the recording material P on the recording surface by means of a repulsive electric field with the surficial insulative releasing layer 31 of the elastic pressure roller 18 between. Alternatively, a method in which a fixing bias having the polarity reverse to the unfixed toner image T is applied to the metal core 29 of the elastic pressure roller 18 to induce a charge with the polarity reverse to the unfixed toner image T on the surface of the elastic pressure roller 18 so as to attract the unfixed toner image T toward the recording material P has also been adopted.

In order to enhance the effect further, a method as shown in FIG. 8 has been adopted. In this method, a static elimination means 52 such as an electrically conductive brush is provided downstream of the fixing nip portion N with respect to the recording material conveying direction in such a way that the static elimination means 52 is in contact with the surface opposite to the recording surface of the recording material P that has passed through the fixing nip portion N, and a bias having a polarity the same as or reverse to the unfixed toner image T is applied to the fixing film 14 or the elastic pressure roller 18 in a similar manner as the above-mentioned methods. Thus, a charge having a polarity the same as or reverse to the fixing bias applied from a mount portion of the static elimination means 52 is induced via the resistance of the recording material P, so that the induced charge attracts the unfixed toner image T that has the reverse polarity to the recording material so as to fix the unfixed toner image T thereon.

There is an optimum value for the fixing bias for preventing the electrostatic offset, and a fixing bias larger than or smaller than the optimum value would make electrostatic offset worse. On the other hand, it is desirable that the fixing bias for preventing the backward toner flying is as high as possible. Therefore, if the value of the fixing bias is set to the optimum value for the electrostatic offset, the backward toner flying will be significantly generated, though the electrostatic offset can be prevented completely. On the other hand, if the fixing bias is set as high as possible in order to prevent the backward toner flying completely, the electrostatic offset will be significantly generated. In view of the above situations, the fixing bias is set to a value with which both the electrostatic offset and the backward toner flying are kept to satisfactory degrees.

In the above-described heat fixing apparatus, in the case that recording materials (or small size media) having a width smaller than the maximum passable sheet width of the apparatus are consecutively fed and the heat fixing process is ceaselessly performed, the temperature of such an area (which is referred to as a non-sheet passing area) in the fixing nip portion through which the recording materials do not pass will continuously increase, since there is no media that removes heat from that area. On the other hand, the temperature of such an area (referred to as a sheet passing area) in the fixing nip portion through which the recording materials pass is kept to a predetermined temperature by a temperature control system. Therefore, the temperature difference between the non-sheet passing area and the sheet passing area of the fixing nip becomes large, which is a so-called over temperature rise phenomena in the non-sheet passing portion.

In the graph shown in FIG. 9, the abscissa axis represents time. The area designated with the caption "SMALL SIZE PRINT" represents the period through which printing was consecitively performed on small size sheets. After that period, printing was consecutively performed on standard size sheets, which corresponds to the area designated with the caption "STANDARD SIZE PRINT". The temperature of the non-sheet passing area and the sheet passing area was measured, and the graph illustrates that the temperature rise in the non-sheet passing area becomes large.

When printing is performed on a recording material (a large size media) having a width larger than the above-mentioned recording material while the over temperature rise phenomena is occurring in the non-sheet passing area, the temperature distribution in the longitudinal direction within the fixing nip portion is like shown in FIG. 10. Specifically, since in the sheet passing area with respect to the small size media a predetermined fixing temperature has been kept, a satisfactory fixed image can be obtained in the image area corresponding to this sheet passing area with respect to the small size media. However, in the non-sheet passing area temperature has been raised due to the printing on the recording material with a small width, namely the temperature has been raised higher than the predetermined temperature for the sheet passing area. Therefore hot offset due to over-fixing will occur in the image area corresponding to this non-sheet passing area with respect to the small size media.

In addition, under such a state in which the temperature in the fixing nip portion is very high and hot offset can easily occur, the process is very sensitive to the fixing bias, and therefore if the fixing bias is not appropriate, a severe image error that involves both the electrostatic offset and the hot offset will occur.

In order to prevent this hot offset, when printing is to be performed on an standard size recording material(s) after the printing on small size recording materials, the fixing temperature is reduced to a temperature lower than the normal fixing temperature for standard size recording materials in accordance with the number of the small size recording materials that have been printed as shown in Table 1 so as to suppress the hot offset.

TABLE 1

| Number of Printed Small Size Sheets | 1–10 | 11–30 | 31–50 | 51– |
|---|---|---|---|---|
| Temperature Setting for Standard Sheets | −10° C. | −20° C. | −30° C. | −40° C. |

However, as the number of the printed small size recording materials increases, the temperature rise in the non-sheet passing area becomes so high that a certain degree of hot offset would occur, even if the fixing temperature for standard recording materials is reduced as shown in Table 1. In addition, if the fixing temperature is further reduced with the view of preventing the hot offset, a fixing error will occur in the sheet passing area with respect to the small size recording materials.

SUMMARY OF THE INVENTION

The present invention has been made in view of the above-described problems. An object of the present invention is to prevent the offset that may occur when a large size recording material(s) is fed for printing just after a small size recording material(s) has been fed and printed in an image forming apparatus having an image heating apparatus that is adapted to hold and convey a recording material that bears an image in a nip between a heating member and a pressurizing member, to at least one of which a bias is applied, to heat the image on the recording material.

According to the present invention, there is provided image forming apparatus having the structures described in the following.

(1) An image forming apparatus having an image heating apparatus for holding and conveying a recording material that bears an image in a nip between a heating member and a pressurizing member, to at least one of which a bias is applied, to heat the image on the recording material, wherein in the case that a recording material(s) having a width smaller than the maximum passable sheet width of the apparatus is fed and thereafter a recording material having a larger width is to be fed, an amount of said applied bias is set based on the number of the recording material(s) having the small width that have been fed and the time from the completion of the feeding of the recording material(s) having the small width to the feeding of the recording material having the larger width.

(2) An image forming apparatus as described in the above paragraph (1), wherein said heating member comprises a supporting member provided with a flexible moving member supported thereon and a heater for applying heat having a sliding surface that is in sliding contact with said moving member.

(3) An image forming apparatus as described in the above paragraphs (1) or (2) wherein the amount of the applied bias that has been set based on the number of recording material(s) having the small width that have been fed and the time from the completion of the feeding of the recording material(s) having the small width to the feeding of the recording material having the larger width is varied stepwise, so that the amount of the applied bias is returned to an amount of the applied bias for ordinary printing.

(4) An image forming apparatus as described in any one of the above paragraphs (1) to (3), wherein the larger the number of the recording material(s) having the small width that have been fed is, the longer the time during which a sequence in which the bias is set to a value different from an ordinary set value in the case that the recording material having the large width is to be fed after the feeding of the recording material(s) having the small width is kept active.

(5) An image forming apparatus as described in any one of the above paragraphs (1) to (4), wherein a static elimination means is provided downstream of said nip with respect to recording material conveying direction.

As per the above, the image forming apparatus has an image heating apparatus that causes a recording material on which an unfixed image is formed to pass in a nip formed by a heating member and a pressurizing member that are in pressure contact with each other to fix the unfixed image on the recording material as a permanent image and means for applying a bias for preventing the offset and the backward toner flying to at least one of the pressurizing member and the heating member, wherein the fixing bias is set based on the preceding printing history and printing information on current job, and specifically, in the case that printing on a large width recording material is to be performed within a predetermined time after the completion of printing on a small width recording material(s), the fixing bias is set to an optimum value for the purpose of preventing the offset.

According to the present invention, in the image forming apparatus having an image heating apparatus that causes a recording material on which an unfixed image if formed to pass in a nip formed by a heating member and a pressurizing member that are in pressure contact with each other to fix the unfixed image on the recording material as a permanent image and means for applying a bias for preventing the offset and the backward toner flying to at least one of the pressurizing member and the heating member, images that are satisfactory with respect to both the offset and the backward toner flying can be obtained by setting a value of the fixing bias smaller than an ordinary value in the case that printing on a large width recording material is to be performed within a predetermined time after printing on a small width recording material(s). In addition, by setting the fixing bias to an optimum value based on the number of printed small size recording materials and the time from the completion of the printing on the small size recording materials to printing on a standard size recording material, the level of the backward toner flying can be improved. Furthermore, the level of the backward toner flying can also be improved by making the fixing bias closer to the ordinary value every time a standard size recording material is printed.

DESCRIPTION OF THE PREFERRED EMBODIMENTS (Embodiment 1)

(1) Description of an Example of an Image Forming Apparatus

Figure 1:
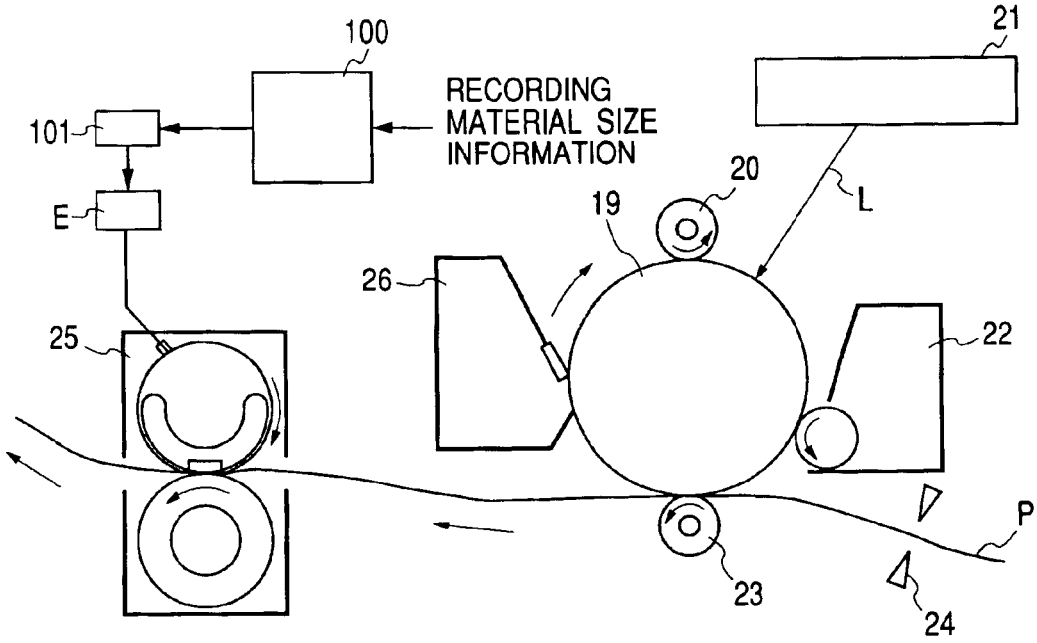
FIG. 1 is a drawing schematically showing the structure of an image forming apparatus according to embodiment 1.

FIG. 1 is a drawing schematically showing the structure of an image forming apparatus according to a first embodiment. This example of the image forming apparatus is a laser printer utilizing an electrophotography process.

Reference numeral 19 designates a photosensitive drum, in which a photosensitive material such as OPC, amorphous Se, or amorphous Si is formed on a cylindrical substrate made of aluminum or nickel or the like.

The photosensitive drum 19 is driven to rotate in the direction indicated by an arrow, and its surface is first uniformly charged by a charging roller 20 serving as a charging apparatus.

Next, the uniformly charged surface of the photosensitive drum 19 is subjected to laser beam scanning exposure L by a laser scanner unit 21, so that an electrostatic latent image in accordance with image information is formed. The laser beam scanning exposure L to the photosensitive drum 19 is performed by a laser beam that is controlled to be turned on and off in accordance with the image information and reflected by a polygon mirror rotating in the laser scanner unit 21. The electrostatic latent image is developed and visualized by a developing apparatus 22. The developing method may be toner projection development, two component development or FEED development, and a combination of image exposure and reversal processing is often used.

The visualized toner image is transferred, by means of a transferring roller 23 serving as a transferring apparatus, from the photosensitive drum 19 onto a recording material P that is conveyed from a sheet feeding mechanism (not shown) at a predetermined timing. In that process, a sensor 24 detects the leading edge of the recording material P so that the timing would be adjusted in such a way that the image forming position of the toner image on the photosensitive drum 19 and the recording start position at the leading edge of the recording material P coincide with each other. The recording material P that has been conveyed at a predetermined timing is held between the photosensitive drum 19 and the transferring roller 23 with a constant pressurizing force so as to be conveyed. In this embodiment, the conveying of recording materials inside the apparatus is performed as center basis conveying.

The recording material P on which the toner image has been transferred is conveyed to a heat fixing apparatus 25, in which the toner image is fixed as a permanent image.

On the other hand, residual toner remaining on the photosensitive drum 19 is removed from the surface of the photosensitive drum 19 by a cleaning apparatus 26.

Reference numeral 100 designates a control circuit portion of the image forming apparatus, and it controls a sequence of the image forming operations of the image forming apparatus as a whole. Reference character E designates a power source for applying a fixing bias for the fixing apparatus 25, and reference numeral 101 designates a driver for the power source E. In the conveying path of the recording material P from the sheet feeding portion (not shown) to the fixing apparatus 25, there is provided a width sensor that is adapted to operate in the case that a recording material P has a width exceeding a predetermined width. The control circuit portion 100 determines the size of a recording material P that is fed to the apparatus based on a signal provided by this width sensor or on a signal of a sensor equipped in a sheet feeding cassette (not shown), and in the case that a recording material(s) P having a width smaller than the maximum passable sheet width of the apparatus is fed and thereafter a recording material P having a width larger than the preceding material is to be fed, the control circuit portion 100 controls the amount of the fixing bias applied to the fixing apparatus 25 by controlling the output of the power source E via the driver 101 based on the number of the small width recording materials P that have been fed and on the time elapsed from the completion of the printing of the small width recording materials P until the printing of the large width recording material P. This control process will be described later.

(2) Heat Fixing Apparatus 25

Figure 2:
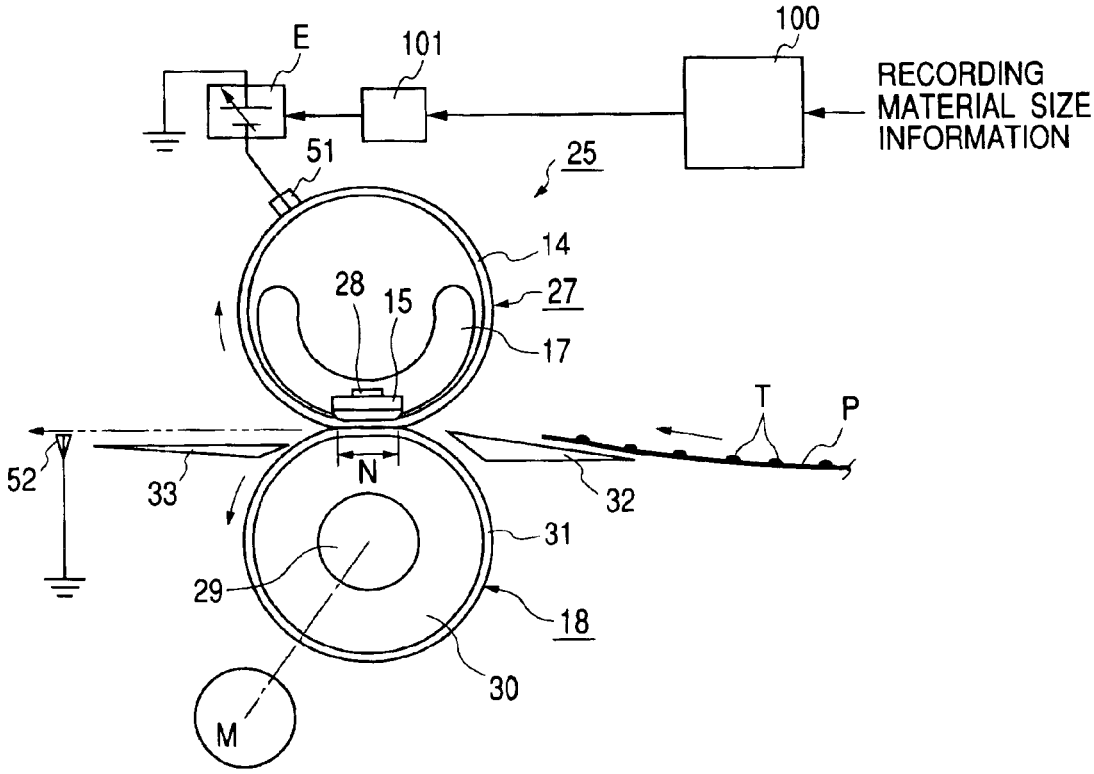
FIG. 2 is a drawing schematically showing the structure of a heat fixing apparatus.

FIG. 2 is a drawing schematically showing the structure of the heat fixing apparatus 25. The heat fixing apparatus 25 in this embodiment is a heating apparatus using a film heating scheme and a pressurizing rotating element driving scheme (tensionless type), which uses a cylindrical (in the form of an endless belt) flexible fixing film functioning as a moving member. Such an apparatus is disclosed in Japanese Patent Application Laid-Open Nos. 4-44075 to 44083 and 4-204980 to 204984.

1) Overall Structure of Fixing Apparatus 25

Reference numeral 27 designates a heating member (i.e. a fixing unit or a fixing film assembly) and reference numeral 18 designates a pressure roller serving as a pressurizing member. These elements 27 and 18 are in pressure contact with each other to form a fixing nip portion N.

The heating member 27 is a member whose longitudinal axis is perpendicular to the plane of the drawing sheet. The heating member 27 is composed of a heat resisting rigid stay holder (i.e. a supporting member) 17 having a transverse cross section of a substantially semicircular canaliculated shape, a ceramic heater 15 serving as a heating member fitted in a concave groove formed along and on the bottom surface of the stay holder 17 along its longitudinal direction and fixed in the concave groove and a heat resisting flexible cylindrical fixing film 14 with a small heat capacity functioning as a moving member that is loosely fitted over the stay holder 17 to which the heater 15 is attached.

The pressure roller 18 is a rotatable member composed of a metal core 29 and an elastic layer 30 concentrically formed on the metal core 29 by a heat resisting rubber such as a silicon rubber or a fluororubber or a foamed silicon rubber. On the elastic layer 30, there may be provided a heat resisting releasing layer 31 made of a fluorocarbon resin such as PFA, PTFE or FEP.

More specifically, the pressure roller 18 is made by providing the elastic layer 30 formed by a silicon rubber or the rubber foam elastic layer 30 formed by foaming a silicon rubber on the outer surface of the metal core 29 and further providing, on the outer surface of the elastic layer 30, a releasing layer 31 in the form of a tube or a coating made of PTFE, PFA or FEP or the like.

The pressure roller 18 is disposed in such a way that both end portions of the metal core 29 are rotatably supported between a front plate and a back plate of the apparatus chassis (not shown) by means of a bearing member.

The heating member 27 is disposed above the pressure roller 18 and in parallel with the pressure roller 18 with the heater 15 side facing downward. Both end portions of the stay holder 17 are biased in the axial direction of the pressure roller 18 by pressing means such as a spring(s) (not shown), so that the lower surface of the heater 15 is in pressure contact with the elastic layer 30 of the pressure roller 18 via the fixing film 14 with a predetermined pressing force against the elasticity of the elastic layer 30. Thus, the fixing nip portion N having a predetermined width required for heat-fixing is formed. The fixing apparatus 25 may be so modified that the fixing nip portion N having a predetermined width is formed by pressing the pressure roller 18 by pressing means upwardly against the lower surface of the heating member 27.

The pressure roller 18 is rotationally driven by driving means M in the counterclockwise direction as shown by an arrow at a predetermined circumferential speed. By virtue of a pressure contact frictional force created by the rotational driving of the pressure roller 18 between the pressure roller 18 and the fixing film 14 at the fixing nip portion N, a rotational force is exerted on the cylindrical fixing film 14. Thus, the fixing film 14 is in a driven rotation state in the clockwise direction on the outer circumference of the stay holder 17 with its inner side being in contact with and sliding on the lower surface of the heater 15.

A recording material P bearing an unfixed toner image T is guided along a fixing entrance guide 32 having heat resisting properties and introduced into the fixing nip portion N between the fixing film 14 and the pressure roller 18 under the state in which the pressure roller 18 is rotationally driven, the cylindrical fixing film 14 is in the driven rotation state, the heater 15 is supplied with power, and the temperature of the heater 15 has been raised to a predetermined temperature and controlled. The recording material P is held and conveyed through the fixing nip portion N together with the fixing film 14 with the toner image bearing surface of the recording material P being in close contact with the outer surface of the fixing film 14 in the fixing nip portion N. In this holding and conveying process, heat of the heater 15 is given to the recording material P via the fixing film 14, so that the unfixed toner image T on the recording material P is heated and pressed onto the recording material P so as to be melted and fixed.

While the recording material P is conveyed in the fixing nip portion N, a bias with the polarity the same as the unfixed toner image T is applied by a power supplying brush 51, so that offset and backward toner flying would be suppressed. Downstream of the fixing nip portion N with respect to the recording material conveying direction, there is provided a static elimination brush 52 to be in contact with the surface of the recording material P opposite to the printing surface. The recording material P that has passed through the fixing nip portion N is guided by a fixing sheet discharge guide 33 having heat resisting properties and discharged to a discharge tray (not shown).

2) Heater 15

Figure 3A:
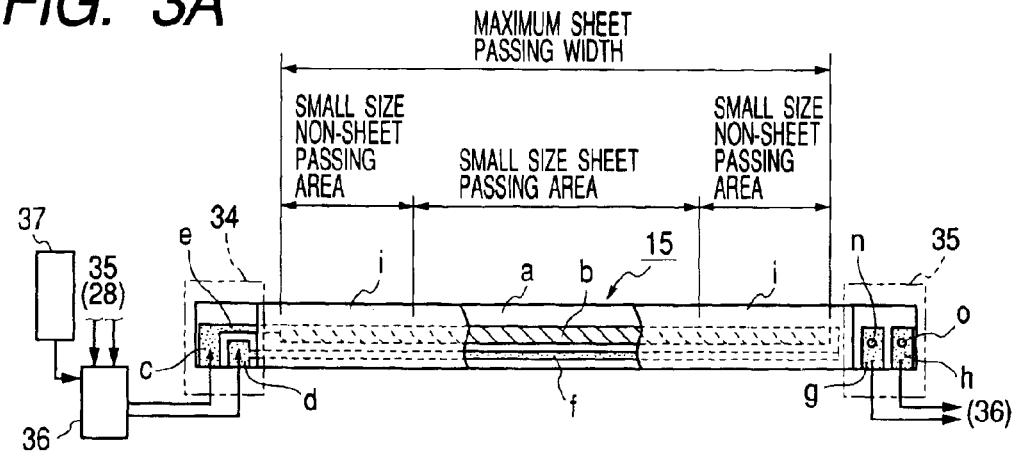
FIGS. 3A, 3B and 3C are drawings schematically showing the structure of a ceramic heater.
Figure 3B:
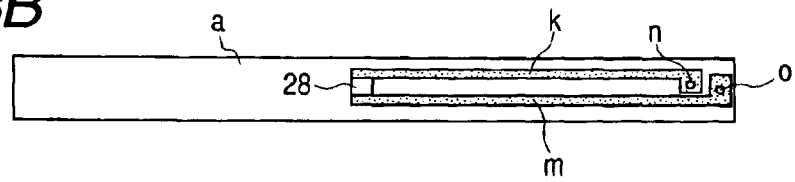
Figure 3C:
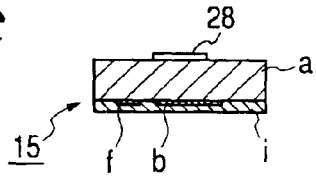

FIGS. 3A to 3C are drawings schematically showing the structure of the ceramic heater 15 serving as a heating member in this embodiment, in which FIG. 3A shows the outer appearance (partially cut away), FIG. 3B shows the backside, and FIG. 3C shows a transversal cross section in an enlarged manner.

This heater 15 is composed essentially of:

(1) a heater substrate a having an elongated shape with the longitudinal direction extending perpendicular to the sheet feeding direction and made of a material having heat resisting properties, high insulation properties, a high thermal conductivity and a low heat capacity, such as a ceramic like alumina, a polyimide, PPS or a liquid crystal polymer;

(2) a heat generating layer (or resistance layer for generating heat with electric power) b having a thickness of about 10 $\mu$m and a width of about 1 to 5 mm that is applied by screen printing or the like method in a linear or band pattern along the longitudinal direction on the surface side of the heater substrate a and made of an electric resistance material, such as a silver palladium (Ag/Pd), $RuO_2$ or $Ta_2N$, that generates heat when an electrical current flows therethrough;

(3) first and second electrode portions c and d and extended electric path portions e and f, which are formed as a power supply pattern for the heat generating layer b by screen printing or the like using silver paste applied on the surface side of the heater substrate a, and third and fourth electrode portions g and h for thermistor output (which will be described later).

(4) a protect layer i that is formed on the heat generating layer b and the extended electric path portions e and f, in order to protect them and to ensure insulation, as a thin glass coating or a fluorocarbon resin layer with a thickness of about 10 $\mu$m and having wear resisting properties against friction with the fixing film 14; and (5) a thermistor 28 serving as a temperature detection element and extended electric path portions k and m for thermistor output provided on the backside of the heater substrate a.

The third and fourth electrode portions g and h for thermistor output and the terminals of the extended electric path portions k and m are electrically connected via through holes n and o respectively.

The above-described heater 15 is fixedly supported by the stay holder 17 with its surface side being exposed downwardly.

A connector for power supply 34 is attached to the first and second electrode portions c and d of the heater 15. On the other hand, a connector for temperature control circuit 35 is attached to the third and fourth electrode portions g and h.

With power supply to the first and second electrode portions c and d from a heater driving circuit 36 via the connector for power supply 34, the heat generating layer b generates heat, so that the temperature of the heater 15 rises rapidly (AC line).

The temperature of the heater 15 is detected by the thermistor 28, and electrical information indicative of the detected temperature is input to the heater driving circuit 36 via the third and fourth electrode portions g and h and the connector for temperature control circuit 35 (DC line).

The heater driving circuit 36 controls the output power of the power supply circuit in terms of the duty ratio or the wave number of the voltage appropriately so that the temperature detected by the thermistor 28 would be maintained at a predetermined temperature (i.e. the fixing temperature). Thus the surface temperature of the fixing film 14 in the fixing nip portion N is maintained at a temperature that enables fixing. In other words, the controlled temperature at the fixing nip portion N is kept substantially constant, so that heating necessary for fixing of a toner image on a recording material is realized.

The heater 15 is a metal heater for heating that is formed by sequentially laminating an insulation layer and resistance layer for generating heat with electric power on the surface of a metal substrate facing away from the fixing nip portion N. The surface of the metal substrate facing the fixing nip portion N may be of a curved shape. If the heater substrate a is made of a material having a good abrasion resistance and a good thermal conductivity such as AlN (aluminum nitride), the heat generating layer b may be formed on the side of the heater substrate a that is opposite to the fixing nip portion N.

2) Stay Holder 17

The stay holder 17 is made, for example, of a heat resisting plastic material. The stay holder 17 holds the heater 15 and also serves as a transfer guide for the fixing film 14. Therefore, a grease with a high heat resistance or the like is provided between the fixing film 14 and the outer surfaces of the heater 15 and the stay holder 17 in order to enhances slidability with the fixing film.

More specifically, the stay holder 17 is a heat insulating member that holds the heater to prevent heat radiation in the direction opposite to the fixing nip portion N and made of a liquid crystal polymer, a phenolic resin, PPS or PEEK. The fixing film 14 is loosely fitted on the stay holder 17 with play so as to be rotatable in the direction indicated by an arrow. Since the fixing film 14 is rotated under sliding contact with the heater 15 and the stay holder 17 that are disposed inside, it is necessary to make the frictional resistance between the fixing film 14 and the heater 15 or the stay holder 17 small. For this purpose, a lubricant such as a heat resisting grease is provided on the surface of the heater 15 and the stay holder 17, which enables smooth rotation of the fixing film 14.

3) Fixing Film 14

It is preferable that the fixing film 14 operating as a moving member has a total thickness equal to or smaller than 100 $\mu$m and preferably equal to or smaller than 60 $\mu$m from the standpoint of reducing its heat capacity to enhance quick-start ability. In order to prevent offset or to ensure releasability of recording materials, coating of a heat resisting resin having a good releasability such as a fluorocarbon resin, e.g. PTFE (polytetrafluoroethylene), PFA (tetrafluoroethlene-perfluoroalkylvinylether copolymer), FEP (tetrafluoroethylene-hexafluoropropylene copolymer) ETFE (ethylene-tetrafluoroethylene copolymer), CTFE (polychlorotrifluoroethylene) or PVDF (polyvinylidenefluoride) or a silicone resin or their mixture is applied on the surface of the fixing film 14.

More specifically, the thickness of the fixing film 14 is made as small as 20 to 70 μm in order to transfer the heat of the heater 15 to recording materials in the fixing nip portion N. The fixing film 14 has a three-layer structure including a film base layer, an electrically conductive primer layer and a releasing layer, with the film base layer facing the heater side and the releasing layer facing the pressure roller side.

The film base layer is made of a highly insulative material such as polyimide, polyamide-imide or PEEK and having heat resisting properties and a high elasticity with a thickness of about 15 to 60 μm that ensures resiliency. The film base layer ensures physical strength such as tearing strength of the fixing film 14 as a whole.

The electrically conductive primer layer is formed as a thin layer with a thickness of about 2 to 6 μm and part of it is exposed as the surface of the fixing film 14. In order to prevent electrostatic offset or the like, the electrically conductive primer layer that is exposed as the surface of the fixing film 14 is adapted to be in contact with the power supply brush or electrically conductive brush 51, so that a bias (i.e. the fixing bias) of the polarity same as the unfixed toner image T is applied to it from the power source E during the printing process. In this embodiment, the charge polarity of the unfixed toner image T is minus, and a minus charging bias is applied from the power source E. The application of the charging bias may be performed by applying a bias with the polarity reverse to the unfixed toner image T to the pressure roller 18, or the charging bias may be applied to both of them.

The releasing layer is a layer that prevents the toner offset onto the fixing film 14. The releasing layer is formed as a coating made of a fluorocarbon resin having a good releasability such as PFA, PTFE, FEP or the like with a thickness of about 5 to 15 μm. In addition, in order to relieve charging-up of the surface of the fixing film 14 and to prevent electrostatic offset, an electrically conductive material such as carbon black or the like having a resistivity of $10^3$ Ωcm to $10^6$ Ωcm is added in the releasing layer.

(3) Fixing Bias Sequence

As mentioned before, a width sensor that is adapted to operate in the case that a recording material P has a width exceeding a predetermined width is provided in the conveying path of the recording material P from the sheet feeding portion (not shown) to the fixing apparatus 25. In addition, the control circuit portion 100 determines the size of a recording material P that is fed to the apparatus based on a signal provided by this width sensor or on a signal of a sensor equipped in a sheet feeding cassette (not shown), and in the case that a recording material(s) P having a width smaller than the maximum passable sheet width of the apparatus is fed and thereafter a recording material P having a width larger than the preceding material is to be fed, the control circuit portion 100 controls the fixing bias applied to the fixing apparatus 25 by controlling the output from the power source E to the electrically conductive brush 51 via the driver 101 based on the number of the small width recording materials P that have been fed and on the time elapsed from the completion of the printing of the small width recording materials P until the printing of the large width recording material P.

In the above-described process, the completion of the printing of the small width recording materials P is defined, in this embodiment, as the time at which the trailing edge of the last small width recording material P passes the position of a sheet discharge sensor (not shown) disposed downstream of the fixing nip portion N of the fixing apparatus 25 with respect to the recording material conveying direction. In addition, the time of the printing of the large width recording material P is defined, in this embodiment, as the time a predetermined time before the leading edge of the first large width recording material P will enter the fixing nip portion N, and the above-mentioned time is calculated by the control circuit portion 100.

The fixing bias for printing on standard size recording materials P is determined in the following manner.

The fixing bias is applied in order to suppress offset and backward toner flying. We evaluated the level of the offset and the backward toner flying while varying the value of the fixing bias. The results are shown in Table 2.

These evaluations were performed using sheets and printing patterns that are apt to cause the offset and the backward toner flying, and therefore in the case of ordinary use, a level equivalent to or better than level Δ (Δ denotes "fair") is acceptable without any problem. The evaluation of the offset was performed using Xerox papers of 75 g/m$^2$ that are apt to cause the offset, and the evaluation of the backward toner flying was performed using Badger bond papers of 60 g/m$^2$ that are of a poor backward toner flying level.

TABLE 2

| Fixing Bias | 0 V | −100 V | −300 V | −600 V | −900 V |
|---|---|---|---|---|---|
| Offset | x | ○ | Δ | ○ | x |
| Backward Toner Flying | x | Δ$^x$ | Δ | ○Δ | ○ |

○: good
Δ: fair
$^x$poor

As per the above, as for the offset, the fixing bias of −100V is the best and the offset becomes worse as the fixing bias increases or decreases from −100V. On the other hand, the backward toner flying becomes better as the fixing bias increases. In the case that the fixing bias is set to −100V, there is no problem as to the offset, but the backward toner flying is of a bad level. On the other hand, in the case that the fixing bias is set to −900V with the view to improve the level of the backward toner flying, the offset is deteriorated. In the case that the fixing bias is set to −600V, both the offset and the backward toner flying are of relatively good levels. In view of the above-described results, the fixing bias for ordinary printing is to be set to −600V.

Table 3 shows the values of the fixing bias and the results of evaluations of the offset and the backward toner flying under the condition that printing on a sheet of the standard size recording material was performed ten seconds after the consecutive printing on thirty small size recording materials in the form of mailing envelopes of the com #10 size. The evaluation of the offset was performed in the non-sheet passing area with respect to the small size recording material in which the offset is apt to occur.

TABLE 3

| Fixing Bias | 0 V | −100 V | −300 V | −600 V | −900 V |
|---|---|---|---|---|---|
| Offset | x | ○ | Δ$^x$ | x | x |
| Backward Toner Flying | Δ$^x$ | Δ | Δ | ○Δ | ○ |

○: good
Δ: fair
$^x$poor

The offset occurring in this case is mainly hot offset caused by an increase in the temperature in the non-sheet passing area, and the offset level greatly varies depending on the fixing bias. In fact, the offset level was generally deteriorated and the level equivalent to or better than level Δ was attained only in the case of the fixing bias of −100V.

On the other hand, the level of the backward toner flying was improved more or less. It is considered that this was because during the printing of the small size recording material, the shape of the pressure roller became an inverted crown shape due to thermal expansion caused by an increase in temperature in the non-sheet passing area with respect to the small size recording material and the conveying speed at both end portions became faster than the conveying speed at the central portion. Specifically, in the case that the conveying speed is the same at the central portion and both end portions, the recording material is slightly corrugated in the conveying direction and the vertical direction. The top ridge portions of the corrugation (i.e. the portions close to the fixing film) are easy to be influenced by heat before entering the fixing nip, and therefore those portions gradually exude vapor before they enter the fixing nip. On the other hand, the bottom ridge portions of the corrugation (i.e. the portions distant from the fixing film) are hard to be influenced by heat, and therefore those portions exude little vapor before they enter the fixing nip. When the bottom ridge portions that have exuded little vapor enter the fixing nip portion, they exude vapor at one burst at the moment of entering the fixing nip, so that the vapor strongly blows unfixed toner toward the upstream direction. However, in the case that the conveying speed at both end portions is faster than the conveying speed at the central portion, the recording material is conveyed while strained toward both ends, and therefore the above-mentioned top ridge portions and bottom ridge portions are not present. Thus, it is considered that the level of the backward toner flying is improved.

For this reason, the level was equivalent to or better than level Δ in the case of the fixing bias equal to or larger than −100V. In view of the above-mentioned results, in the occasion just after printing was performed on small size recording materials, in which the temperature of the non-sheet passing area with respect to the small size recording material has increased, the fixing bias is to be set to −100V to prevent deterioration in the offset.

As time elapses after the completion of the printing on the small size recording materials, the temperature of the non-sheet passing area with respect to the small size recording material decreases, and the offset does not occur even if printing on standard size recording material is performed under that state. In addition, since the printing on the standard size recording material lowers the temperature of the non-sheet passing area with respect to the small size recording medium, the offset will not occur after printing is performed on several standard size recording materials. Therefore, the fixing bias is set to −100V in such a case that the time from the completion of the printing on the small size recording material until the printing on the standard size recording material does not exceed 120 seconds and during the printing on the first to fifth ordinary recording materials, and after that, the fixing bias is set to the normal fixing bias of 600V.

With the above-described control process, printing on five sheets of the LTR size was performed ten seconds after printing on thirty mailing envelopes of the com #10 size.

As comparative examples, evaluations were also performed under the following conditions:

(1) Comparative example 1: printing on the standard size recording materials just after the printing on the small size recording materials was performed with the normal fixing bias of −600V;

(2) Comparative example 2: printing on the standard size recording materials just after the printing on the small size recording materials was performed with the normal fixing bias of −600V, and in addition the fixing temperature during the printing on the standard size recording materials is lowered by 10° C.

The evaluations were made on the offset, the backward toner flying and the fixing quality in the sheet passing area with respect to the small size recording material. The results are shown in Table 4.

TABLE 4

| | This Embodiment | Comparative Example 1 | Comparative Example 2 |
|---|---|---|---|
| Offset | ○ | x | ○ |
| Backward Toner Flying | Δ | ○Δ | ○Δ |
| Fixing Quality | ○ | ○ | $\Delta^x$ |

○: good
Δ: fair
xpoor

As per the above, in comparative example 1, the fixing quality and the backward toner flying were of good levels, but the offset was deteriorated to level $\Delta^x$ under the condition in which the temperature of the non-sheet passing area with respect to the small size recording medium had been increased.

In comparative example 2, since the fixing temperature was low, the offset was not remarkable, but the fixing quality was deteriorated.

On the other hand, in the embodiment in which in the case that printing was to be performed on the standard size recording materials after printing on the small size recording materials, the fixing bias was set to −100V only for the first five standard size recording materials, all of the offset, the backward toner flying and the fixing quality were well balanced and good quality images could be obtained.

As per the above, by setting the fixing bias for the case in which printing was to be performed on standard size recording materials after printing on small size recording materials to a value with which the offset and the backward toner flying would not occur, it was possible to obtain good quality images even in the period just after the printing on the small size recording materials in which the temperature of the non-sheet passing area with respect to the small size recording material was high.

(Embodiment 2)

The overall structure of an image forming apparatus and heat fixing apparatus according to this embodiment 2 is the same as that of the above-described embodiment 1, and the description thereof will be omitted. A characterizing feature of this embodiment resides in that the fixing bias is determined in accordance with the number of small size recording materials that have been printed and the time elapsed from printing on the small size recording materials until printing on a standard size recording material.

Figure 4:
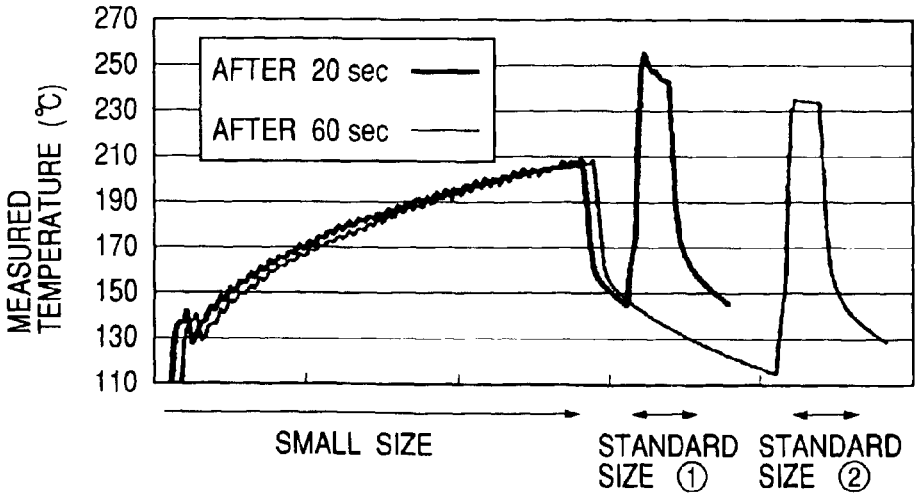
FIG. 4 shows results of temperature measurement on a non-sheet passing area with respect to a small side sheet.

We measured the temperature of the non-sheet passing area with respect to the small size recording material at the time of printing on a standard size (or large size) recording material after consecutive printing on small size recording materials with the temperature being controlled to 145° C. The results are shown in FIG. 4. In connection with this, the "ordinary set temperature" is the temperature that is set for fixing of standard size recording materials. In FIG. 4, the abscissa axis represents time. The graph captioned as "after 20 sec" represents the result of the temperature measurement on the non-sheet passing area in the case that printing on a standard size recording material was performed 20 seconds after printing on small size recording materials. Similarly, the graph captioned as "after 60 sec" represents the result of the temperature measurement on the non-sheet passing area in the case that printing on a standard size recording materials was performed 60 seconds after printing on small size recording materials. Standard size (1) and standard size (2) respectively represent the fact that the printing on a standard size recording material was performed 20 seconds and 60 seconds after the completion of the printing on small size recording materials. When the small size recording material passes through the fixing nip portion N, since the width of the recording material is significantly small as compared to the width (or length) of the heat generating layer b of the heater 15, heating is performed in the state in which the heat of the heater 15 is not removed from the heater 15 in the non-sheet passing area. Therefore, the temperature of the non-sheet passing area increases as the number of printed small size recording materials increases. In contrast, the temperature of the sheet passing area is so controlled by means of the temperature detection element 28 as to be constant. Therefore, the temperature difference between the sheet passing area and the non-sheet passing area becomes large. After the completion of the printing on the small size recording materials, the temperature rise of the non-sheet passing area decreases with time.

Portion (1) in FIG. 4 represents the case in which printing on a standard size recording material was performed 20 seconds after printing on 40 (forty) small size recording materials. In this case, since the time interval from the completion of the printing on the small size recording materials to the printing on the standard size recording material was so short that the printing on the standard size recording material was performed in the state in which the temperature of the non-sheet passing area had not decreased yet, the temperature of the non-sheet passing area with respect to the small size recording material rose over 250° C., and considerable hot offset occurred.

On the other hand, portion (2) in FIG. 4 represents the case in which the printing on a standard size recording material was performed 60 seconds after the printing on the small size recording materials. In this case, since the time interval from the completion of the printing on the small size recording materials to the printing on the standard size recording material was relatively short and the printing on the standard size recording material was performed in the state in which the temperature of the non-sheet passing area had been decreased to some extent, the temperature of the non-sheet passing area with respect to the small size recording material was about 230° C.

As per the above, the offset in the printing on a standard size recording material after the printing on small size recording materials greatly depends on the time from the completion of the printing on the small size recording materials to the printing on the standard size recording material, and the shorter the time is, the worse the offset is, In addition, the temperature of the non-sheet passing area with respect to the small size recording material increases with the increase in the number of the printed small size recording materials.

In view of the above, in this embodiment the fixing bias for the case in which a standard size recording medium is fed within a predetermined time after printing on a small size recording material(s) is set relatively low in order to prevent the offset from occurring. The fixing bias to be set is determined based on the number of the printed small size recording materials at that time and the time from the printing on the small size recording materials to the printing on the standard size recording material. Table 5 is an example of a table used for this determination. The control circuit portion 100 is provided with this table for the determination, and the control circuit portion 100 controls the charging bias in accordance with the table.

TABLE 5

| | Number of Printed Small Size Sheets | | | |
|---|---|---|---|---|
| | 1–10 | 11–20 | 21–30 | 31– |
| 0–30 sec | −500 V | −300 V | −100 V | −100 V |
| 31–60 sec | −600 V | −500 V | −300 V | −100 V |
| 61–90 sec | −600 V | −600 V | −500 V | −300 V |
| 91–120 sec | −600 V | −600 V | −600 V | −500 V |

We evaluated the offset and the backward toner flying under the above control conditions for the cases in which printing was performed on a standard size recording material 10, 40, 70 and 100 seconds after printing on 10, 20, 30 and 40 mailing envelopes of the com #10 size.

The evaluation of the offset was performed using Xerox papers of 75g/m$^2$ that are apt to cause the offset, and the evaluation of the backward toner flying was performed using Badger bond papers of 60g/m$^2$ that are of a poor backward toner flying level.

The evaluation was also performed in the same manner on a comparative example (C.E.) in which the fixing bias was set to −100V constantly for 120 seconds after the completion of the printing on the small size recording materials, irrespective of the number of the printed small size recording materials and the time from the printing on the small size recording materials to the printing on the standard size recording material. The results are shown in Tables 6 and 7.

TABLE 6

| Evaluation of Offset | | | | | | | | |
|---|---|---|---|---|---|---|---|---|
| | Number of Printed Small Size Sheets | | | | | | | |
| | 10 sheets | | 20 sheets | | 30 sheets | | 40 sheets | |
| | Emb. | C. E. | Emb. | C. E. | Emb. | C. E. | Emb. | C. E. |
| 10 sec after | ○ | ○ | ○ | ○ | ○ | ○ | ○Δ | ○Δ |
| 40 sec after | ○ | ○ | ○ | ○ | ○ | ○ | ○ | ○ |
| 70 sec after | ○ | ○ | ○ | ○ | ○ | ○ | ○ | ○ |
| 100 sec after | ○ | ○ | ○ | ○ | ○ | ○ | ○ | ○ |

○: good
Δ: fair
x: poor

TABLE 7

| Evaluation of Backward Toner Flying | | | | | | | | |
|---|---|---|---|---|---|---|---|---|
| | Number of Printed Small Size Sheets | | | | | | | |
| | 10 sheets | | 20 sheets | | 30 sheets | | 40 sheets | |
| | Emb. | C. E. | Emb. | C. E. | Emb. | C. E. | Emb. | C. E. |
| 10 sec after | ○Δ | Δ | Δ | Δ | Δ | Δ | Δ | Δ |
| 40 sec after | ○Δ | Δ | ○Δ | Δ | Δ | Δ | Δ | Δ |
| 70 sec after | ○Δ | Δ | ○Δ | Δ | ○Δ | Δ | Δ | Δ |
| 100 sec after | ○Δ | Δ | ○Δ | Δ | ○Δ | Δ | ○Δ | Δ |

○: good
Δ: fair
x: poor

As per the above, in this embodiment the fixing bias was set close to an ordinary set value, in accordance with the number of the printed small size recording materials and the time from the printing on the small size recording materials to the printing on the standard size recording material, to an extent that would not deteriorate the offset. Therefore, the level of the backward toner flying was also improved, while the offset was kept to a good level.

On the other hand, in the comparative example, since the fixing bias was −100V irrespective of the number of the printed small size recording materials and the time from the printing on the small size recording materials to the printing on the standard size recording material, the offset was kept to a good level. However, the level of the backward toner flying was worse as compared to the embodiment in the case in which the number of the printed small size recording materials was small or in the case in which the time from the printing on the small size recording materials to the printing on the standard size recording material was long.

As per the above, it was possible to improve the level of the backward toner flying in the case in which the number of the printed small size recording materials was small or in the case in which the time from the printing on the small size recording materials to the printing on the standard size recording material was long by setting the fixing bias close to an ordinary set value, in accordance with the number of the printed small size recording materials and the time from the printing on the small size recording materials to the printing on the standard size recording material, to an extent that would not deteriorate the offset.

(Embodiment 3)

The overall structure of an image forming apparatus and heat fixing apparatus according to this embodiment 3 is the same as that of the above-described embodiment 1 or 2, and the description thereof will be omitted. In this embodiment also, the fixing bias is determined in accordance with the number of small size recording materials that have been printed and the time elapsed from printing on the small size recording materials until printing on a standard size recording material, and a characterizing feature of this embodiment resides in that the fixing bias is gradually made closer to an ordinary set value as standard size recording materials pass one by one.

The temperature of the non-sheet passing area with respect to the small size recording material is increased by printing on a small size recording material(s). However, if printing on a standard size recording material(s) is performed thereafter, the temperature of the non-sheet passing area with respect to the small size recording material is reduced, since heat of the non-sheet passing area is removed by the standard size recording material(s). Therefore, the printing on the standard size recording material(s) decreases the offset.

In view of this, in this embodiment the fixing bias at the time of printing on a standard size recording material after printing on small size recording materials is set in the manner shown in Tables 8 to 11, in accordance with the number of the printed small size recording materials. The control circuit portion 100 is provided with these tables and the control circuit portion 100 controls the fixing bias in accordance with them.

TABLE 8

| | Number of Small Size Prints = 1–10 | | | | |
|---|---|---|---|---|---|
| | Standard Size Recording Material | | | | |
| | 1st | 2nd | 3rd | 4th | 5th |
| 0–30 sec | −500 V | −600 V | −600 V | −600 V | −600 V |
| 31–60 sec | −600 V | −600 V | −600 V | −600 V | −600 V |
| 61–90 sec | −600 V | −600 V | −600 V | −600 V | −600 V |
| 91–120 sec | −600 V | −600 V | −600 V | −600 V | −600 V |

TABLE 9

| | Number of Small Size Prints = 11–20 | | | | |
|---|---|---|---|---|---|
| | Standard Size Recording Material | | | | |
| | 1st | 2nd | 3rd | 4th | 5th |
| 0–30 sec | −300 V | −500 V | −600 V | −600 V | −600 V |
| 31–60 sec | −500 V | −600 V | −600 V | −600 V | −600 V |
| 61–90 sec | −600 V | −600 V | −600 V | −600 V | −600 V |
| 91–120 sec | −600 V | −600 V | −600 V | −600 V | −600 V |

TABLE 10

| | Number of Small Size Prints = 21–30 | | | | |
|---|---|---|---|---|---|
| | Standard Size Recording Material | | | | |
| | 1st | 2nd | 3rd | 4th | 5th |
| 0–30 sec | −100 V | −300 V | −500 V | −600 V | −600 V |
| 31–60 sec | −300 V | −500 V | −600 V | −600 V | −600 V |
| 61–90 sec | −500 V | −600 V | −600 V | −600 V | −600 V |
| 91–120 sec | −600 V | −600 V | −600 V | −600 V | −600 V |

TABLE 11

| | Number of Small Size Prints = 21–30 | | | | |
|---|---|---|---|---|---|
| | Standard Size Recording Material | | | | |
| | 1st | 2nd | 3rd | 4th | 5th |
| 0–30 sec | −100 V | −100 V | −300 V | −500 V | −600 V |
| 31–60 sec | −100 V | −300 V | −500 V | −600 V | −600 V |
| 61–90 sec | −300 V | −500 V | −600 V | −600 V | −600 V |
| 91–120 sec | −500 V | −600 V | −600 V | −600 V | −600 V |

We evaluated the offset and the backward toner flying under the above control conditions for the case in which printing was performed on recording materials of the LTR size 10 (ten) seconds after printing on 30 (thirty) mailing envelopes of the com #10 size.

The evaluation was also performed in the same manner on a comparative example (C.E.) in which the fixing bias was set to a constant value for the first to fifth normal size recording materials that were subjected to printing after printing on the small size recording materials. The results are shown in Table 12.

TABLE 12

| | | 1st | 2nd | 3rd | 4th | 5th |
|---|---|---|---|---|---|---|
| Offset | Emb. | ○Δ | ○ | ○ | ○ | ○ |
| | C. E. | ○Δ | ○ | ○ | ○ | ○ |

TABLE 12-continued

| | | 1st | 2nd | 3rd | 4th | 5th |
|---|---|---|---|---|---|---|
| Toner Fly | Emb. | Δ | ○Δ | ○Δ | ○Δ | ○Δ |
| | C. E | Δ | Δ | Δ | Δ | Δ |

○: good
Δ: fair

As to the first recording material sheet, since the set bias was the same as that in Embodiments 1 and 2, the offset was good and the level of the backward toner flying was slightly worse as compared to ordinary printing, though there was no problem with that. As to the second sheet, since the fixing bias was set in such a way that the backward toner flying would be improved as compared to the first sheet and the temperature of the non-sheet passing area had been decreased, the offset and the backward toner flying were improved as compared to the first sheet. As to the third sheet, the offset and the backward toner flying were improved as compared to the second sheet. As to the fourth sheet, since the fixing bias had been returned to the ordinary set value and the temperature difference between the sheet passing area and the non-sheet passing area with respect to the small size recording medium had become small, the offset and the backward toner flying were improved as compared to the third sheet.

(Others)

1) It is apparent that the structure of the ceramic heater 15 serving as a heating member is not limited to that used in the embodiments.

Figure 5:
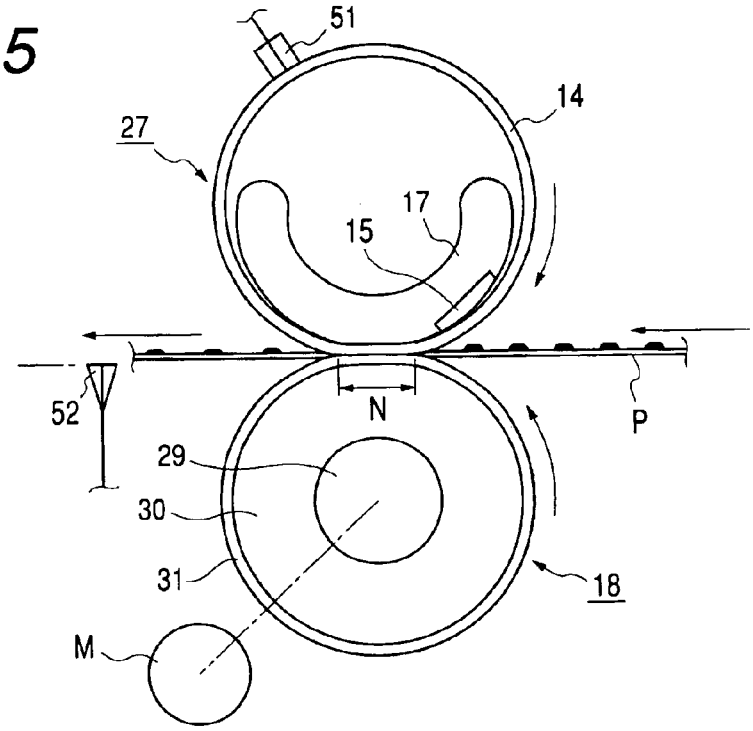
FIG. 5 is a drawing schematically showing another heat fixing apparatus.

The heater 15 is not necessarily required to be positioned at the fixing nip portion N. For example as shown in FIG. 5, the heater 15 may be disposed upstream of the fixing nip portion N with respect to the fixing film 14 moving direction.

Figure 6:
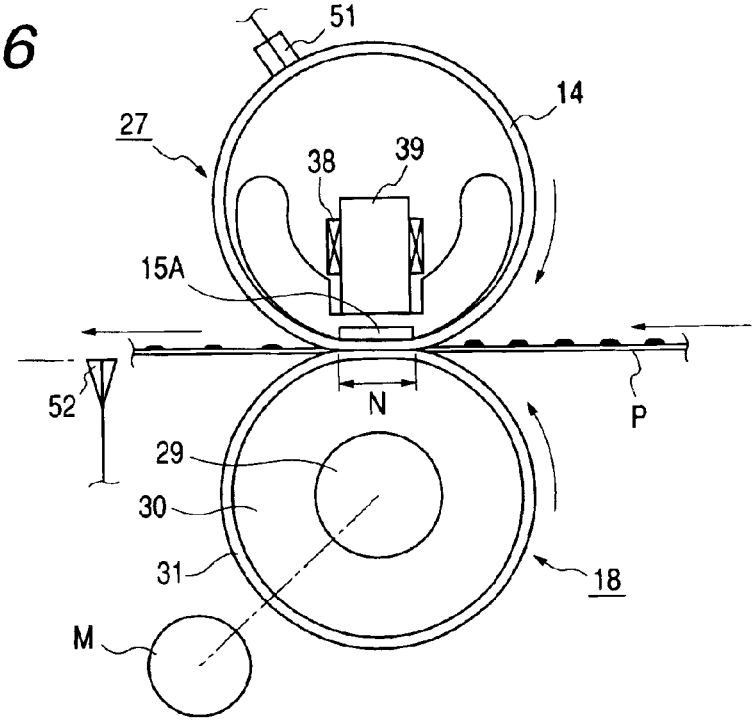
FIG. 6 is a drawing schematically showing still another heat fixing apparatus.
Figure 7:
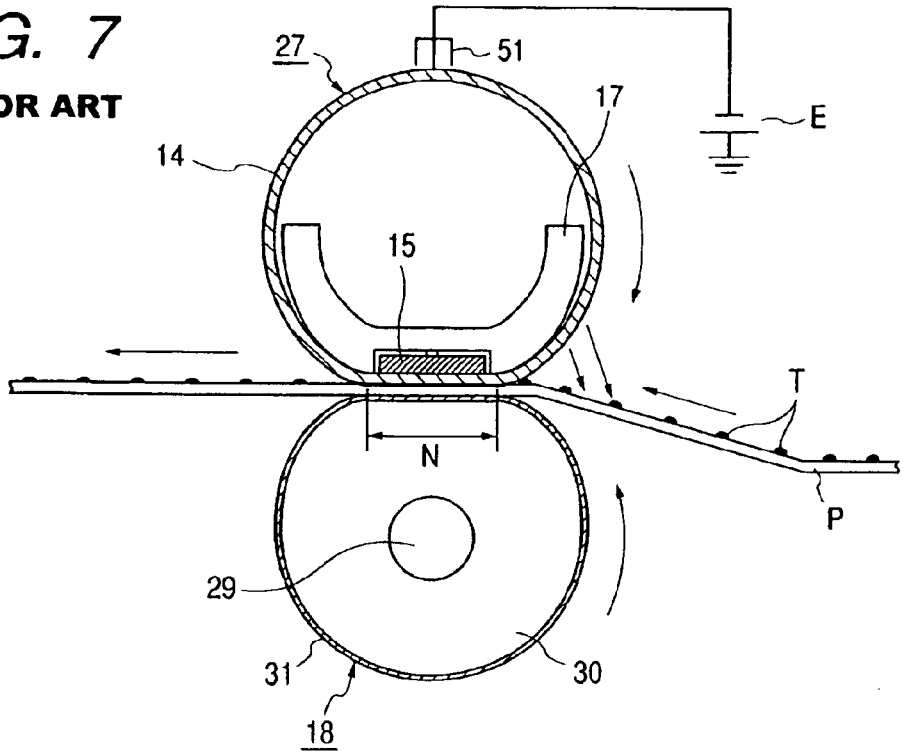
FIG. 7 PRIOR ART
FIG. 7 is a drawing schematically showing the structure of a conventional heat fixing apparatus (first one).
Figure 8:
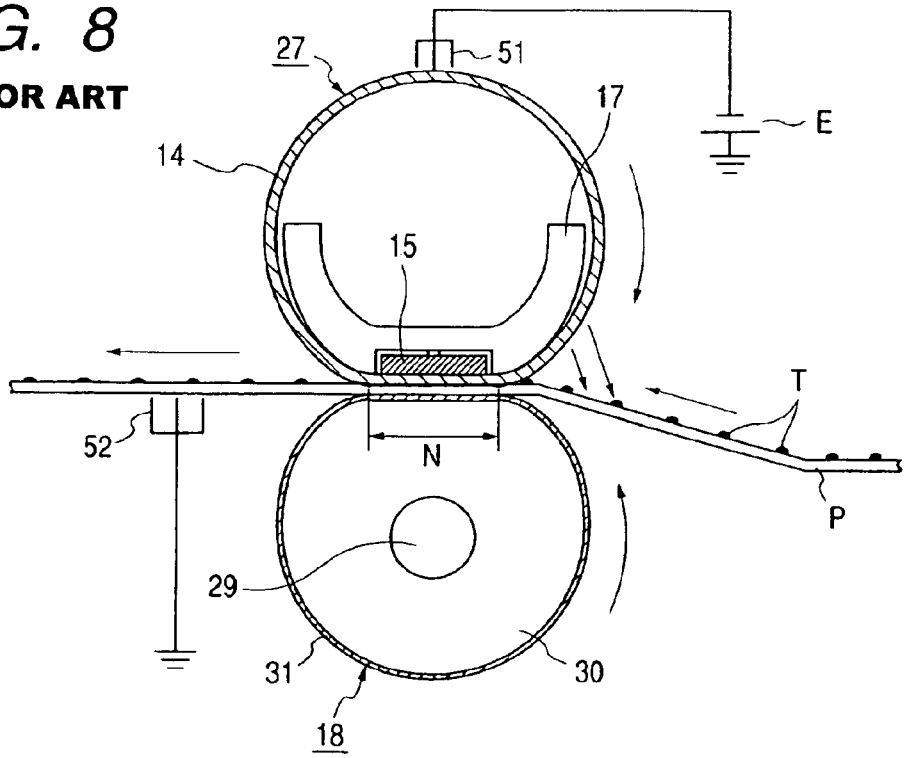
FIG. 8 PRIOR ART
FIG. 8 is a drawing schematically showing the structure of a conventional heat fixing apparatus (second one).
Figure 9:
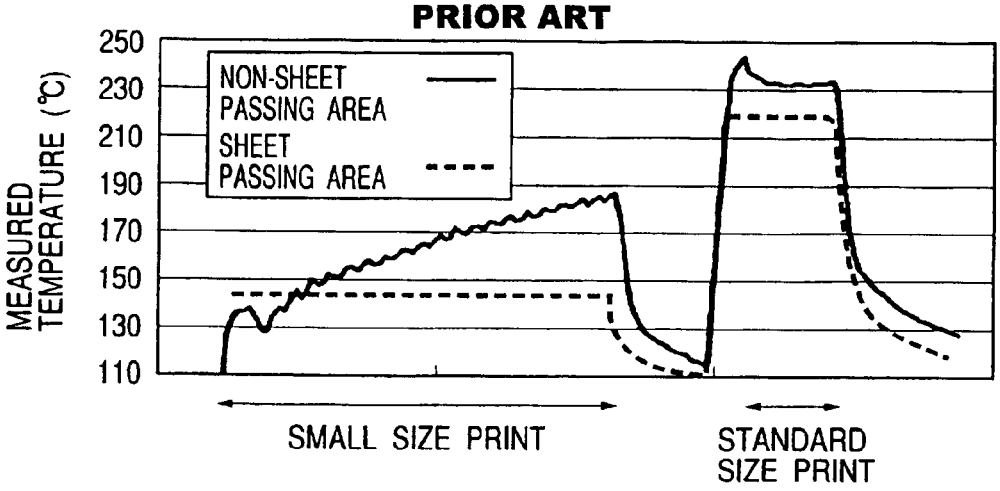
FIG. 9 PRIOR ART
FIG. 9 shows results of temperature measurement on a non-sheet passing area with respect to a small side sheet in the conventional apparatus.
Figure 10:
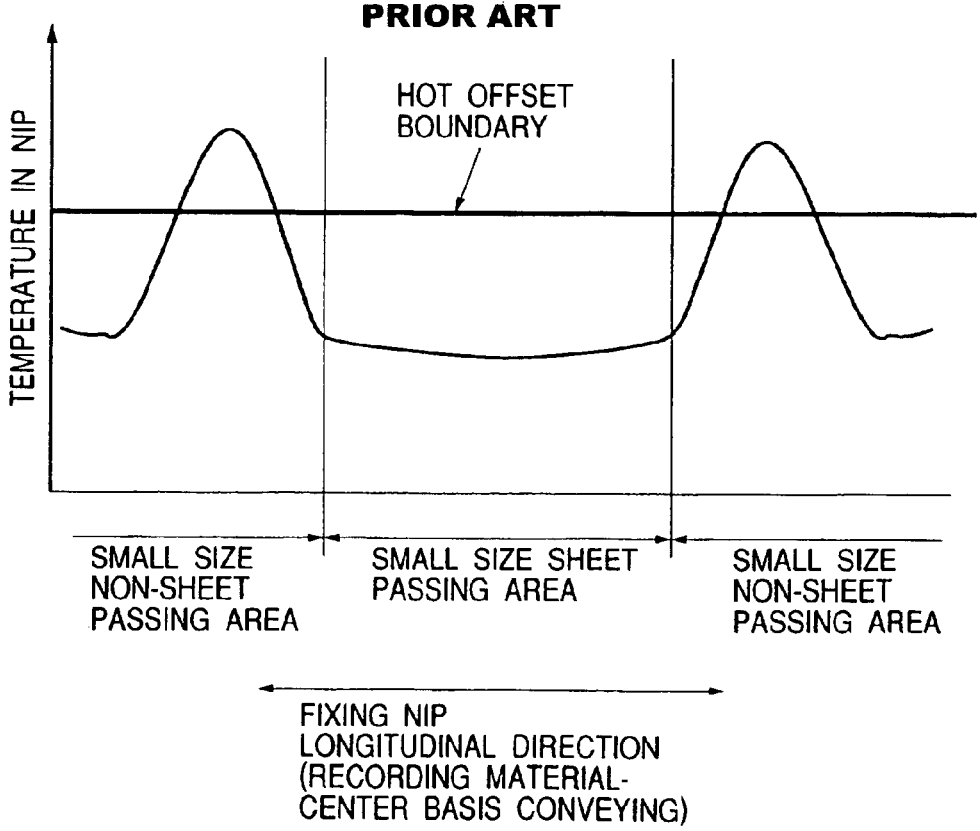
FIG. 10 PRIOR ART
FIG. 10 is a diagram schematically showing a temperature distribution with respect to the longitudinal direction in a conventional heater.

2) The heater 15 is not limited to a ceramic heater. For example, the heater 15 may be a heat generating member using electromagnetic induction, such as a iron plate. As shown in FIG. 6, the structure of the apparatus may be arranged in such a way that a heat generating member using electromagnetic induction ISA disposed at the position of the fixing nip portion N is used as a heater, so that heat is generated by applying a high frequency magnetic field generated by an electromagnetic coil 38 and a magnetic core 39 functioning as means for generating an alternating magnetic flux. In this case also, the heat generating member using electromagnetic induction 15A is not necessarily required to be disposed at the fixing nip portion N.

Alternatively, the apparatus may be modified in such a way that the fixing film 14 as a moving member itself is constructed as a heat generating member using electromagnetic induction that is caused to generate heat by alternating magnetic flux generating means.

3) The heat fixing apparatus using a film heating scheme according to the embodiment is of a type in which the film is driven by a rotating member for applying pressure. However, the apparatus may be modified to have a structure in which a driving roller is provided on the inner circumferential surface of an endless fixing film so that the film is driven under a tensioned state, or a structure in which a rolled film in the form of a web having ends is provided so that it is driven to run.

4) The image heating apparatus according to the present invention is not limited to the apparatus using a film heating scheme, but it may be any image heating apparatus, such as an apparatus using a heating roller scheme that is adapted to heat an image on a recording material while holding the recording material, which bears the image, in the nip between a heating member and a pressurizing member and conveying the recording material between them.

5) The image heating apparatus according to the present invention is not limited to the fixing apparatus for heat fixing an unfixed image on a recording material as a permanent image, but it includes other apparatus such as a heating apparatus for provisionally fixing an unfixed image on a recording material and a heating apparatus for re-heating a recording material bearing an image to change an image surface quality such as a gloss quality.

6) The image forming process of the image forming apparatus is not limited to the electrophotography process, but it may be an electrostatic recording process, a magnetic recording process or the like. In addition, the image forming scheme may be either a transferring scheme or a direct scheme.

What is claimed is:

1. An image forming apparatus having an image heating apparatus for holding and conveying a recording material that bears an image in a nip between a heating member and a pressurizing member to heat the image on the recording material, comprising:

a bias applying portion for applying a bias to at least one of said heating member and said pressurizing member; and a bias setting portion for setting an amount of said applied bias;

wherein in the case that a recording material(s) having a first width is fed and thereafter a recording material having a second width larger than the first width is to be fed, said bias setting portion sets said amount of the applied bias based on the number of the recording material(s) having the first width that have been fed and a time from the feeding of the recording material(s) having the first width to the feeding of the recording material having the second width.

2. An image forming apparatus according to claim 1, wherein said heating member comprises a supporting member provided with a flexible moving member supported thereon and a heater having a sliding surface in sliding contact with said moving member.

3. An image forming apparatus according to claim 1, wherein said bias setting portion varies, after setting the amount of the applied bias based on the number of the recording material(s) having the first width that have been fed and the time from the feeding of the recording material(s) having the first width to the feeding of the recording material having the second width, the amount of the applied bias stepwise depending on the number of the fed recording material having the second width.

4. An image forming apparatus according to claim 1, wherein when the recording material having the second width is to be fed after elapse of a predetermined time after the feeding of the recording material(s) having the first width, said bias setting portion sets a constant amount of the applied bias irrespective of the number of the recording material(s) having the first width that have been fed.

5. An image forming apparatus according to claim 1, wherein a static elimination member is provided downstream of said nip with respect to recording material conveying direction.

6. An image forming apparatus having an image heating apparatus for holding and conveying a recording material that bears an image in a nip between a heating member and a pressurizing member to heat the image on the recording material, comprising:

a bias applying portion for applying a bias to at least one of said heating member and said pressurizing member; and a bias setting portion for setting an amount of said applied bias;

wherein in the case that a certain number of recording materials having a first width is fed and thereafter a recording material having a second width larger than the first width is to be fed, said bias setting portion variably sets said amount of the applied bias according to a time from the feeding of the recording materials having the first width to the feeding of the recording material having the second width.

7. An image forming apparatus according to claim 6, wherein said heating member comprises a supporting member provided with a flexible moving member supported thereon and a heater having a sliding surface in sliding contact with said moving member.

8. An image forming apparatus according to claim 6, wherein said bias setting portion varies, after setting the amount of the applied bias according to the time from the feeding of the recording materials having the first width to the feeding of the recording material having the second width, the amount of the applied bias stepwise depending on the number of the fed recording material having the second width.

9. An image forming apparatus according to claim 6, wherein when the recording material having the second width is to be fed after elapse of a predetermined time after the feeding of the recording materials having the first width, said bias setting portion sets a constant amount of the applied bias.

10. An image forming apparatus according to claim 6, wherein a static elimination member is provided downstream of said nip with respect to recording material conveying direction.

11. An image forming apparatus having an image heating apparatus for holding and conveying a recording material that bears an image in a nip between a heating member and a pressurizing member to heat the image on the recording material, comprising:

a bias applying portion for applying a bias to at least one of said heating member and said pressurizing member; and a bias setting portion for setting an amount of said applied bias;

wherein in the case that a recording material(s) having a first width is fed and thereafter a recording material having a second width larger than the first width is to be fed, said bias setting portion variably sets said amount of the applied bias according to the number of the recording material(s) having the first width that have been fed.

12. An image forming apparatus according to claim 11, wherein said heating member comprises a supporting member provided with a flexible moving member supported thereon and a heater having a sliding surface in sliding contact with said moving member.

13. An image forming apparatus according to claim 11, wherein said bias setting portion varies, after setting the amount of the applied bias according to the number of the recording material(s) having the first width that have been fed, the amount of the applied bias stepwise depending on the number of the fed recording material having the second width.

14. An image forming apparatus according to claim 11, wherein when the recording material having the second width is to be fed after elapse of a predetermined time after the feeding of the recording material(s) having the first width, said bias setting portion sets a constant amount of the applied bias irrespective of the number of the recording material(s) having the first width that have been fed.

15. An image forming apparatus according to claim 11, wherein a static elimination member is provided downstream of said nip with respect to recording material conveying direction.

* * * * *